US006788205B1

(12) United States Patent
Mason et al.

(10) Patent No.: US 6,788,205 B1
(45) Date of Patent: Sep. 7, 2004

(54) SYSTEM AND METHOD FOR VERIFYING SURVEILLANCE TAG DEACTIVATION IN A SELF-CHECKOUT STATION

(75) Inventors: Timothy E. Mason, Buford, GA (US); Robert F. Sadler, Cumming, GA (US)

(73) Assignee: NCR Corporation, Dayton, OH (US)

( * ) Notice: Subject to any disclaimer, the term of this patent is extended or adjusted under 35 U.S.C. 154(b) by 11 days.

(21) Appl. No.: 10/231,995

(22) Filed: Aug. 30, 2002

(51) Int. Cl.[7] ..... G08B 13/18; G08B 13/14; G07G 3/00

(52) U.S. Cl. ..... 340/572.3; 340/572.1; 235/383

(58) Field of Search ..... 340/568.1, 572.1, 340/572.3, 572.4, 572.7, 572.8, 551; 235/375, 383; 186/61; 705/16, 23

(56) References Cited

U.S. PATENT DOCUMENTS

| | | | | |
|---|---|---|---|---|
| 4,141,078 | A | 2/1979 | Bridges, Jr. et al. | |
| 4,458,802 | A | 7/1984 | Maciver et al. | |
| 4,812,629 | A | 3/1989 | O'Neil et al. | |
| 4,881,061 | A | 11/1989 | Chambers | |
| 5,007,518 | A | 4/1991 | Crooks et al. | |
| 5,059,951 | A | 10/1991 | Kaltner | |
| 5,095,195 | A | 3/1992 | Harman et al. | |
| 5,315,096 | A | 5/1994 | Muller et al. | |
| 5,341,125 | A | 8/1994 | Plonsky et al. | |
| 5,500,640 | A | 3/1996 | Zhou et al. | |
| 5,594,228 | A | 1/1997 | Swartz et al. | |
| 5,777,884 | A | 7/1998 | Belka et al. | |
| 5,814,799 | A | 9/1998 | Swartz et al. | |
| 5,979,758 | A | 11/1999 | Swartz et al. | |
| 6,025,780 | A | 2/2000 | Bowers et al. | |
| 6,102,290 | A | 8/2000 | Swartz et al. | |
| 6,154,135 | A | 11/2000 | Kane et al. | |
| 6,155,486 | A | * 12/2000 | Lutz | 235/383 |
| 6,169,483 | B1 | 1/2001 | Ghaffari et al. | |
| 6,189,789 | B1 | * 2/2001 | Levine et al. | 235/383 |
| 6,598,791 | B2 | * 7/2003 | Bellis et al. | 235/383 |
| 2002/0123932 | A1 | * 9/2002 | Brenhouse | 705/16 |
| 2003/0001007 | A1 | * 1/2003 | Lee et al. | 235/383 |
| 2003/0075602 | A1 | * 4/2003 | Wike et al. | 235/383 |

* cited by examiner

*Primary Examiner*—Jeffery Hofsass
*Assistant Examiner*—Anne V. Lai
(74) *Attorney, Agent, or Firm*—Maginot, Moore & Beck LLP; Paul W. Martin

(57) ABSTRACT

A system for verifying deactivation of an EAS tag at a self-checkout counter includes an electronic article surveillance (EAS) tag deactivator for deactivating EAS tags attached to articles processed at a checkout station and an EAS tag interrogator associated with the checkout station that generates an electronic checkout disable signal in response to detection of an EAS tag by the EAS tag interrogator. The checkout disable signal may be used to disable the operation of a self-checkout station component so that the consumer is unable to process additional articles until the EAS tag deactivation operation is successful. The generation and use of the checkout disable signal helps ensure that a consumer at a self-checkout station deactivates all EAS tags attached to articles processed at a self-checkout station during checkout. The checkout disable signal may be sent to the processor of the terminal of the self-checkout station to cause the processor to disable components of the self-checkout station. The processor of the self-checkout station terminal may disable operation of the scanner and/or keyboard so the consumer is not able to scan or otherwise submit additional articles for checkout processing. As long as the article with the active EAS tag remains in the EAS deactivator or article discharge area, the selfcheckout station remains disabled. Once the tag becomes deactivated or the article is removed from the checkout process, the checkout disable signal generation is terminated and the checkout process may continue. Other component disabling may include suspending queries of the product database or the accumulation of price data in response to the checkout disable signal.

24 Claims, 9 Drawing Sheets

SYSTEM AND METHOD FOR VERIFYING SURVEILLANCE TAG DEACTIVATION IN A SELF-CHECKOUT STATION

FIELD OF THE INVENTION

This invention relates generally to article surveillance tags and, more particularly, to the deactivation of article surveillance tags at checkout stations.

BACKGROUND OF THE INVENTION

Self-checkout stations at grocery stores and other retail stores are well known. The stations permit a consumer to scan articles for purchase so the station may identify the articles and a corresponding price. When the consumer indicates all articles for purchase have been presented to the terminal, a sub-total is accumulated, any taxes and discounts are computed, and a total amount due is displayed for the consumer. The station then allows the consumer to select a payment method. The station presents menu selections to the consumer so funds may be transferred to the retailer's account. Upon confirmation of payment, the articles are released to the consumer.

A self-checkout station typically includes a terminal, a scanner and scales for reading unit price codes (UPC) and determining article weight, a cashier keypad and display, a POS terminal for payment entry, a receipt printer, a change unit, and a checkout area for holding articles once they have been scanned. The terminal also includes a display, a processor, memory, programmed instructions, and data peripherals to control the operations of the station. The programmed instructions may contain modules for querying for article prices, computing totals and performing other functions related to the purchase of articles through a self-checkout station. Some checkout stations may also include a security application program that uses data from sensors such as scales to reduce the likelihood that the consumer leaves without scanning all of the articles or exchanges scanned articles with more expensive articles that have not been scanned.

Typically, two or more self-checkout stations are located proximately to one another with a checkout attendant station nearby. The checkout attendant may help consumers who may be using a self-checkout station for the first time, who are having trouble with scanning an article, or who are having difficulty with a payment method or the like. That is, the primary duty of the attendant is to provide assistance to customers who are using the self-checkout stations so they are efficiently used and quickly process customers with their checkouts. Although these attendants are available to assist in security monitoring, such duties actually detract from the performance of their primary duty.

In some retail stores, electronic article surveillance (EAS) systems are used to detect the unauthorized removal of merchandise from the store. EAS systems include surveillance tags that may be attached to articles of merchandise and detection devices that sound an alarm upon detection of a tag. The detection devices are typically located at the doorways of the retail store to reduce the likelihood that the articles are removed from the store without authorization. For articles bearing such tags that are properly purchased at a self-checkout counter, the consumer may present the articles to a checkout attendant who either deactivates the tag or mechanically removes the tag from the article. The removal or deactivation of the tag from a purchased article allows the consumer to proceed past the detection device located at a store exit without activation of an alarm unless the consumer has concealed articles having tags for which the consumer did not pay.

The tags that may be attached to articles of merchandise are well-known and include radio frequency tags, magnetic tags, microwave tags, and resonant tuned tags. The radio frequency, microwave, and resonant tuned tags typically include a fusible link that may be disconnected to deactivate the tag by altering the characteristics of the electrical circuit in a tag. At least two known methods are used to rupture fusible links. One method radiates the tag with radio frequency energy at a power level sufficient to rupture the fusible link while the other method uses a deactivation frequency to open the fusible link in a multifrequency resonant tag circuit. These methods may be used to deactivate a tag that uses a radio frequency circuit. Other tags may use magnetic components and appropriate degaussing methods may be used to deactivate such tags. Typically, magnetic tags include two magnetic circuit components and one of the magnetic circuit components may be selectively magnetized or degaussed. A magnetic EAS tag deactivator may degauss or magnetize the circuit component that has the alterable magnetic characteristic so that the tag no longer responds to the tag interrogation signal emitted by a tag detection device. Of course, tags may also be deactivated by methods that physically remove a tag from an article.

Previously known systems have included tag deactivators in checkout counters for deactivating EAS tags during checkout. For example, U.S. Pat. No. 6,154,135 discloses a bagging area in which a scanner is proximately mounted at the opening of the bag well and a tag deactivator is located at the bottom of the bagging area. When the checkout attendant reaches a hand towards the bag rails extending outwardly from the bag well to remove the bag being filled, a capacitor in a circuit associated with the bag rail senses the attendant's approach and triggers the deactivator. In response, the energized deactivator applies the signal that deactivates the EAS tags attached to articles in the bag above the tag deactivator. U.S. Pat. No. 6,102,290 requires the deactivator to include an indicia reader so that an identification code located on the EAS tag being deactivated may be compared to an identification code on a hanger tag. This comparison verifies that the tag being deactivated is indeed the one attached to the last article scanned. U.S. Pat. No. 5,059,951 is directed to an integrated barcode scanner and tag deactivator that may be coupled to one another to make sure that the data capturing and tag deactivation functions are completed before an article is given to a consumer. U.S. Pat. No. 5,341,125 describes an EAS tag detector that generates a signal to activate an EAS tag deactivator in response to detection of an EAS tag and that helps one orient the EAS tag for effective deactivation. U.S. Pat. No. 6,102,290 discloses a system that selectively enables EAS tag deactivation so tag deactivation cannot occur until the bar code corresponding to the tagged article has been scanned at the self-checkout station. The enabling of the EAS deactivation device requires correspondence between a symbol read from a hanger tag and a symbol read from the surveillance tag. Also, U.S. Pat. No. 6,333,692 is directed to a system that uses data scanned from an article to query a database and determine whether a surveillance tag should be deactivated. The deactivator is energized in response to the database indicating the scanned article should have a surveillance tag. Deactivations are counted and discrepancies between the number of tagged articles scanned and the number of deactivations performed is sent to an in-store processor for storage and audit processing.

While all of these patents address the deactivation of EAS tags after the articles to which the tags are attached are scanned for product information, they do not necessarily assure the complete deactivation of an EAS tag attached to an article that remains under a consumer's control. For example, a consumer using a station embodying the system of the '125 patent could simply remove the article from the detection field before deactivation is complete and continue with the checkout process. Likewise, the system of the '951 patent assumes the checkout station operator continues to hold the EAS tag in operational range of the deactivator until the audible signal indicating an EAS tag is in range of the deactivator ceases. However, a consumer at a self-checkout station, unaware of the purpose for the audible signal, may simply remove the article and drop it in the bagging area so the consumer may continue scanning other articles or attempt to complete the checkout process. The system of the '780 patent requires an intelligent tag and a detector that can interpret the tag data while the system of the '290 patent requires correspondence between data in a barcode and data in the tag. Consequently, these systems are more complicated as they require more intelligence in the tags and deactivators. Furthermore, these intelligent tag systems are directed to ways for thwarting consumer fraud that occurs when a consumer scans an article with one barcode and deactivates an EAS tag attached to a second more expensive article. Self-checkout counters with scales may be used to effectively thwart many such efforts to defraud a retail store so the expense of such intelligent tag systems may be redundant. Finally, the system of the '692 patent simply stores the discrepancy data for determining whether vendors are complying with the requirements for tagging articles supplied to the store.

These previously known systems do not require a consumer at a self-checkout counter to completely deactivate a tag before proceeding with checkout. As a result, the article may be removed from the deactivation area and placed in a bag for removal before the EAS tag is deactivated. When the consumer then proceeds past the detection device at an exit point, the interrogator of the detection device is likely to detect the EAS tag and sound an alarm. The consumer is then subjected to the embarrassment of having to be stopped by store security personnel while the contents of all bags are checked to locate the active EAS tags. The consumer must then wait as store personnel complete the EAS tag deactivation. Thus, there is a need for verifying the successful deactivation of an EAS tag during checkout performed by a consumer. This need is especially acute in the operation of self-checkout counters because consumers are not necessarily familiar with the orientation of EAS tags or the amount of time required for successful deactivation of EAS tags.

What is needed is a way of improving the likelihood that consumers will not proceed with the checkout process until they successfully deactivate an EAS tag for a scanned article.

SUMMARY OF THE INVENTION

The above-noted limitations of previously known checkout stations with EAS tag deactivators have been overcome by a system and method that operate in accordance with the principles of the present invention. The system of the present invention comprises an electronic article surveillance (EAS) tag deactivator for deactivating EAS tags attached to articles processed at a checkout station and an EAS tag interrogator associated with the checkout station that generates an electronic checkout disable signal in response to detection of an EAS tag by the EAS tag interrogator. The checkout disable signal may be used to disable the operation of a self-checkout station component so that the consumer is unable to process additional articles until the EAS tag deactivation operation is successful. The generation and use of the checkout disable signal helps ensure that a consumer at a self-checkout station deactivates all EAS tags attached to articles processed at a self-checkout station during checkout. Use of the checkout disable signal to impede the consumer's progress in the checkout process is discussed in more detail below.

Preferably, the system of the present invention includes a prompter to notify the consumer to perform an EAS tag deactivation operation for an article just scanned or otherwise submitted by the consumer for purchase. The prompter may be an annunciator, or a display, such as the one typically associated with the terminal of a self-checkout station, or a combination of both. The interrogator of the system may be located proximate an article discharge area of the self-checkout station, such as a bag well, or it may be located proximate the EAS tag deactivator so that the interrogator may monitor for the presence of an EAS tag during EAS tag deactivation. In another embodiment of a system of the present invention, a second interrogator may be located in the article discharge area while the first interrogator is located proximate the EAS tag deactivator. In this embodiment, the transfer of the article from the EAS deactivator to the article discharge area does not terminate generation of the checkout disable signal until the EAS tag is completely deactivated or the article with the tag is removed from the checkout process.

The checkout disable signal may be sent to the processor of the terminal of the self-checkout station to cause the processor to disable components of the self-checkout station. For example, the processor of the terminal may disable operation of the scanner and/or keyboard so the consumer is not able to scan or otherwise submit additional articles for checkout processing. As long as the article with the active EAS tag remains in the EAS deactivator or article discharge area, the self-checkout station will remain disabled. Once the tag becomes deactivated or the article is removed from the checkout process, the checkout disable signal generation is terminated and the checkout process may continue. The processor of the terminal may also suspend queries of the product database or the accumulation of price data in response to the checkout disable signal. This type of operation prevents the consumer from simply attempting to complete the checkout process in response to the suspension of the checkout process by the terminal processor. Thus, the consumer is required to either complete the EAS tag deactivation, remove the article from the checkout process, or request assistance from the self-checkout attendant. Any of these actions reduces the likelihood that the consumer attempts to exit past an article detection device with an article having an active EAS tag.

The method of the present invention includes interrogating an EAS tag attached to an article at a self-checkout station to determine whether the EAS tag is active and generating an electronic checkout disable signal in response to the detection of an active EAS tag at the self-checkout station. The method further includes the disabling of one or more components of the self-checkout station in response to the generation of the electronic checkout disable signal. The generation of the checkout disable signal may also be used for prompting a consumer to perform an EAS tag deactivation. The prompting action may be in the form of an audible message, a displayed message, or a combination of an audible and visible message. The interrogation of the EAS tag may occur in conjunction with the deactivating of the EAS tag or it may take place in response to the placement of an article in an article discharge area of the self-checkout station. Alternatively, two interrogations may take place. The first interrogation may occur in conjunction with the deactivating of the EAS tag and the second interrogation may be made in response to the placement of the article in the article discharge area. The second interrogation generates an electronic checkout disable signal in response to detection of an EAS tag in the article discharge area while the first interrogation may or may not continue to generate a checkout disable signal. Instead, the first interrogation may generate a signal indicative of an ongoing EAS deactivation until either the EAS tag is completely deactivated or the article to which the EAS tag is attached is removed from the EAS deactivator.

It is an object of the present invention to suspend the checkout process occurring at a self-checkout station in response to detection of an EAS tag in an EAS deactivator of the self-checkout station.

It is an object of the present invention to generate an electronic signal for controlling self-checkout station components in response to detection of an EAS tag downstream of the submission of an article having an EAS tag at the selfcheckout station.

It is an object of the present invention to encourage consumers to complete the deactivation of EAS tags before leaving a self-checkout station with purchased articles.

It is an object of the present invention to detect an active surveillance tag at a self-checkout station and notify the customer of the active surveillance tag before the customer leaves the self-checkout station.

These and other advantages and features of the present invention may be discerned from reviewing the accompanying drawings and the detailed description of the invention.

BRIEF DESCRIPTION OF THE DRAWINGS

The present invention may take form in various system and method components and arrangement of system and method components. The drawings are only for purposes of illustrating exemplary embodiments and are not to be construed as limiting the invention.

DETAILED DESCRIPTION OF THE INVENNTION

Figure 1A:
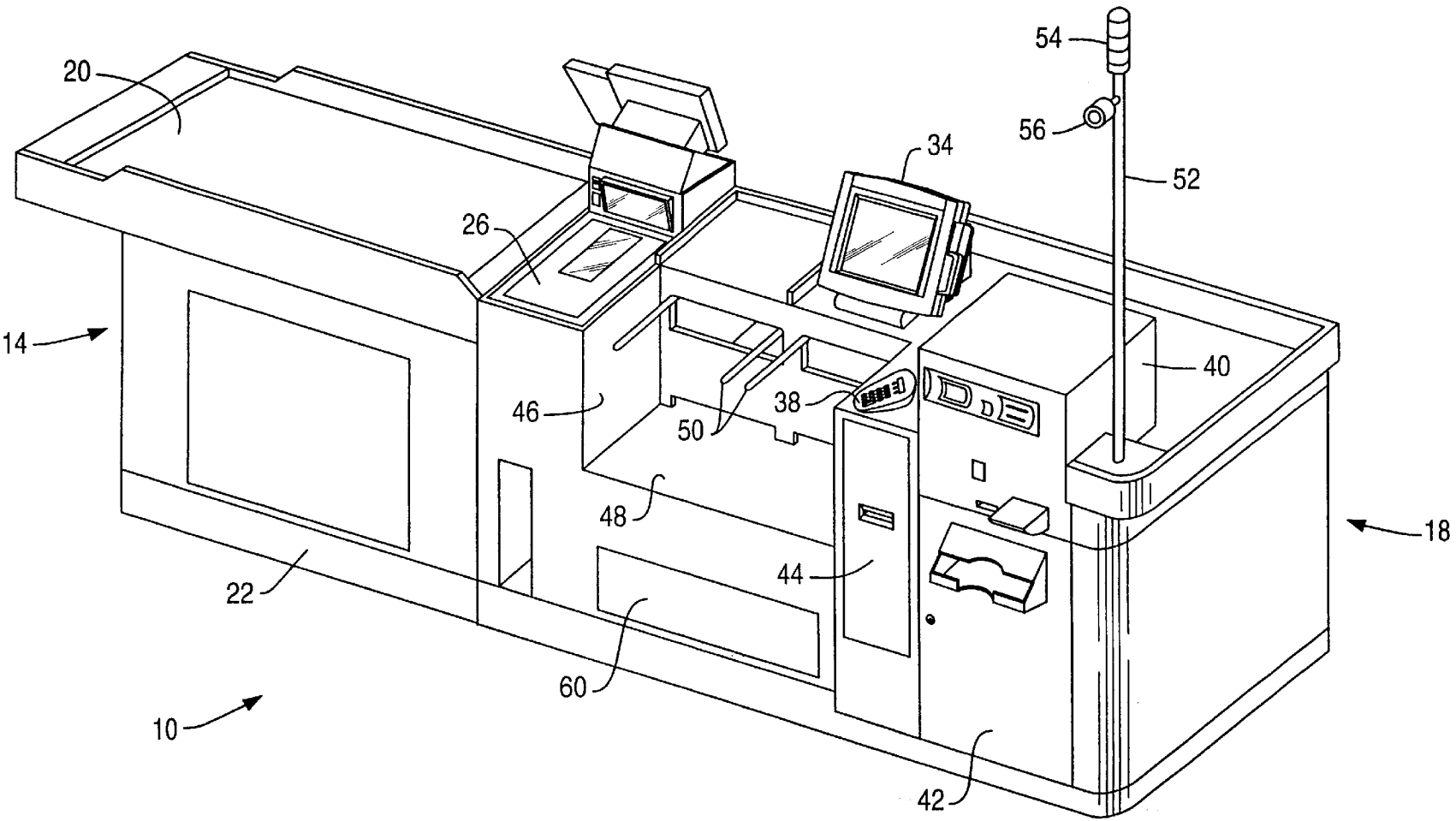
FIG. 1A depicts a typical self-checkout station.

A checkout station incorporating the system and method of the present invention is shown in FIG. 1A. Checkout station 10 may include a feeder unit 14 and a checkstand 18. Feeder unit 14 includes a feeder belt 20 and housing 22 for the motor and control circuitry that operates feeder belt 20. Feeder unit 14 is movably coupled to checkstand 18 so the feeder belt may be aligned with scanner/scale unit 26. Checkstand 18 includes scanner/scale unit 26, consumer terminal 34, a payment terminal 38 for entry of payment data, and receipt printer 44. Scanner/scale unit 26 uses a laser shining on a glass or other transparent platen to input data from bar codes applied to products or packages. Unit 26 may also include a scale for measuring the weight of articles that are sold on a price/unit of weight basis. Consumer terminal 34 displays article data as it is entered through scanner/scale unit 26. Payment terminal 38 may be any known POS terminal that incorporates a keypad and card reader to support credit card, debit card, and other payment methods. Receipt printer 44 provides a consumer with a receipt itemizing the articles purchased and the method of payment.

Receipt printer 44 and scanner/scale unit 26 may be separated by a bag well 46 having a security scale 48 for its floor. Bags for storing articles that consumers have scanned and weighed are hung from hanging rails 50 in bag well 46. Security scale 48 uses article weight data derived from scanner/scale 26 or a database using a scanned unit product code (UPC) to verify that only the articles scanned are placed on the security scale. Security application programs operating within terminal 34 monitor security scale 48 to determine whether articles not scanned have been added to the security scale area. An anomalous condition that requires investigation may be signaled by lighting a warning or alert light color within the tri-color indicator mounted at the terminal end of indicator pole 52 of checkstand 18. A security camera 56 may be mounted onto indicator pole 52 for providing a video signal to a security officer surveillance area or to some storage media. A database, disk drive, or other computer peripheral required for station operation may be housed within peripheral tray 60 located within checkstand 18. Checkstand 18 also includes upper currency module 40 for receiving currency and coins from a consumer as payment for a transaction. Module 40 returns the coin portion of the consumer's change while lower currency module 42 returns the bill portion of the consumer's change.

As shown in FIG. 1A, a consumer may place articles on feeder belt 20 and belt 20 is driven to bring articles to the end of belt 20 where a shut-off mechanism stops belt 20. The consumer may then remove articles from belt 20 and move them, one at a time, over scanner/scale 26 for article product data retrieval and/or weighing. Alternatively, the consumer may pull a cart containing articles for purchase so it is adjacent feeder unit 22 and place articles from the cart onto scanner/scale 26. The scanned articles may then be placed in bags on security scale 48. Once all of the articles are scanned, a consumer may provide payment through payment terminal 38 or currency module 40, receive change from module 44, and a receipt from printer 44. The consumer may then remove the bags from security scale 48 and leave station 10.

Figure 1B:
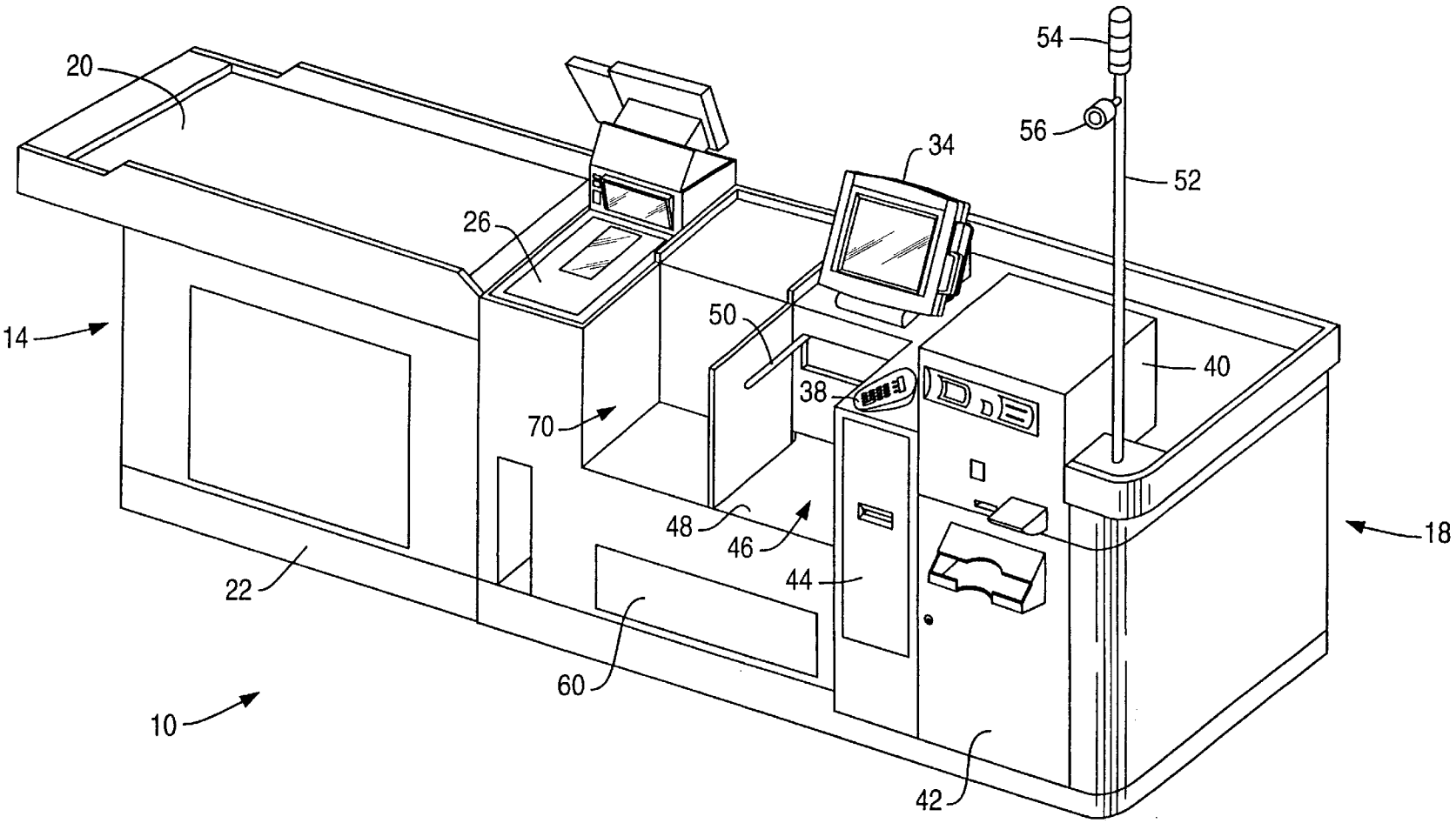
FIG. 1B depicts the self-checkout station of FIG. 1A modified to incorporate the system and method of the present invention.

In one embodiment of the present invention, the self-checkout station of FIG. 1A may be modified to incorporate the system and method of the present invention as shown in FIG. 1B. In FIG. 1B, an EAS deactivator 70 may be placed proximately scanner 26 to radiate the scanning area with the deactivation signal and deactivate active surveillance tags on articles being scanned. Alternatively, the portion of bag well 46 adjacent scanner/scale 26 in FIG. 1A may be modified to house an EAS deactivator 70 so that the bagging area of bag well 46 is comprised of rack 50 and the portion of bag well 46 adjacent receipt printer 44. Security scale 48 may be located so it does not measure weight of articles placed in EAS deactivator 70 but only those articles that rest directly or indirectly on the floor of bag well 46 as shown in FIG. 1B.

Figure 2A:
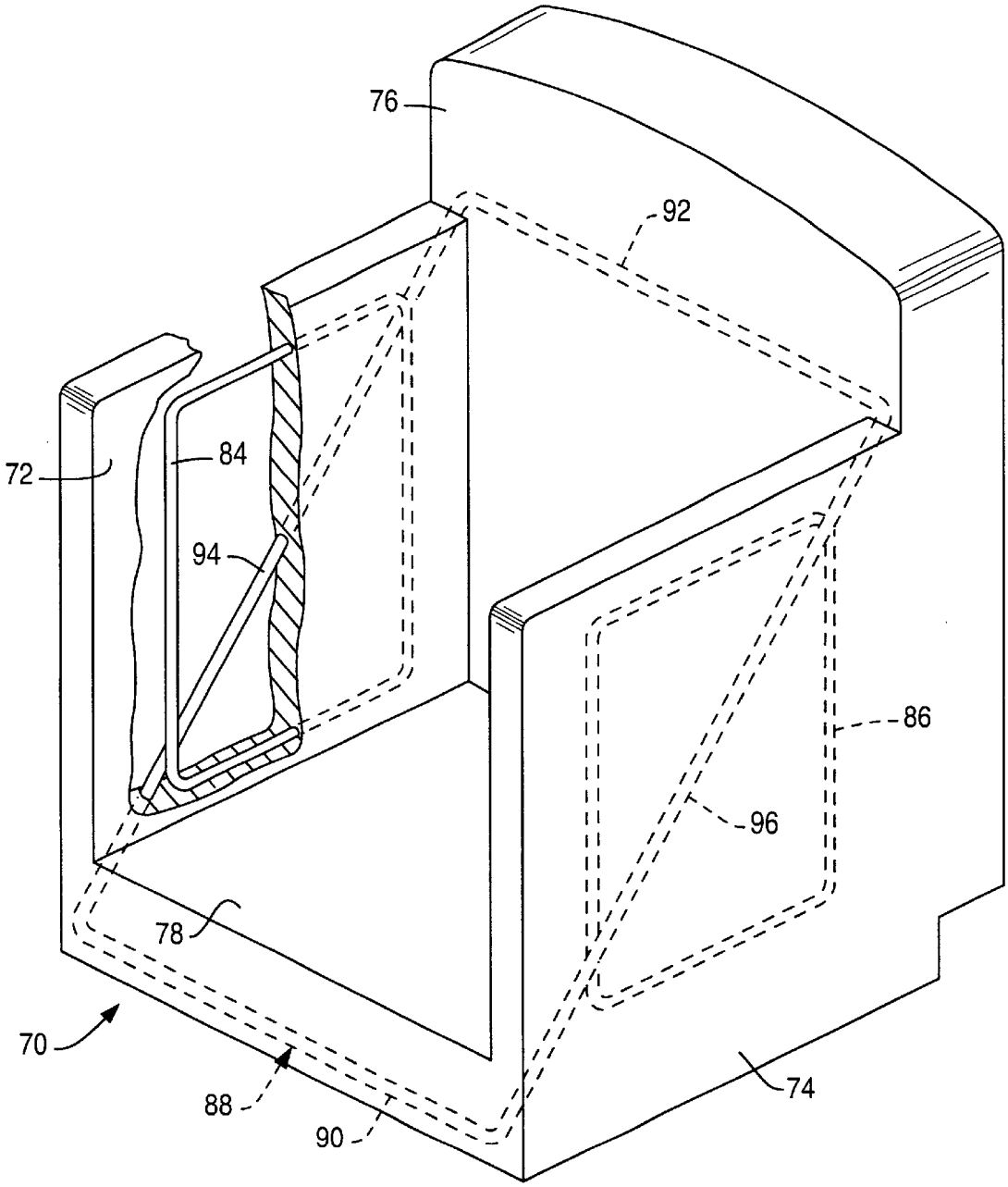
FIG. 2A is a perspective view partially cut away that shows one embodiment of an EAS deactivator that may be used to implement the present invention.

EAS deactivator 70 may be c ons t ructed as shown in FIG. 2A. EAS deactivator 70 may include sidewalls 72, 74, backwall 76, and bottom 78. Mounted substantially parallel with sidewalls 72 and 74 are deactivation coils 84 and 86, respectively. Deactivation coil 88 is comprised of diagonal sections 94 and 96 that are joined by section 90 in bottom 78 and section 92 in backwall 76. Electrical energy may be selectively or continually supplied to deactivation coils 84, 86, and 88 for the purpose of deactivating EAS tags on articles placed in EAS deactivator 70. While the embodiment of FIG. 2A emits magnetic fields for the deactivation of magnetic EAS tags, similar embodiments may be constructed for the deactiva tion of radio frequency (RF or RFID) or intelligent EAS tags. Such embodiments may i nclude antenna s for the emission of electrical power at appropriate power levels and/or frequencies for the rupture of a fusible link or the modification of data in a RF, RFID or intelligent EAS tag.

Figure 2B:
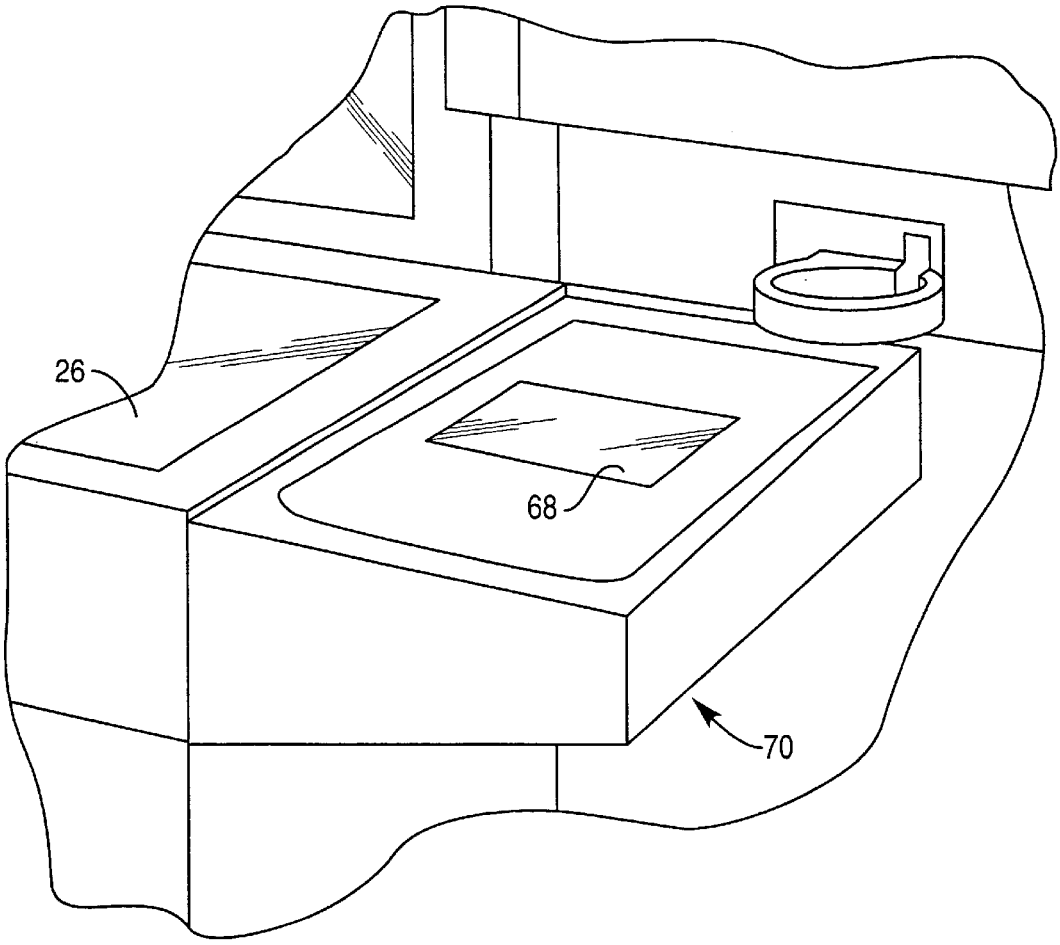
FIG. 2B is a perspective view of a self-checkout station showing a preferred location of an EAS deactivator proximate the scanner of the self-checkout station.

Deactivator 70 may be located proximate scanner 26 of a self-checkout st ation either as shown in FIG. 1B or FIG. 2B. Deactivator 70 may also be implemented to provide a planar surface for deactivating a surveillance tag. Preferably, such a deactivator 70 may be mounte d proximate scanner 26 as shown in FIG. 2B. This embodiment allows a consumer to scan an article and then place the surveillance tag on window 68 of deactivator 70 for deactivating the tag. An interrogator may be located proximate bagwell 46 to detect surveillance tags that were not fully deactivated by the consumer. The interrogator may be located behind the back wall or bottom wall of bag well 46 for detecting surveillance tags.

Figure 3:
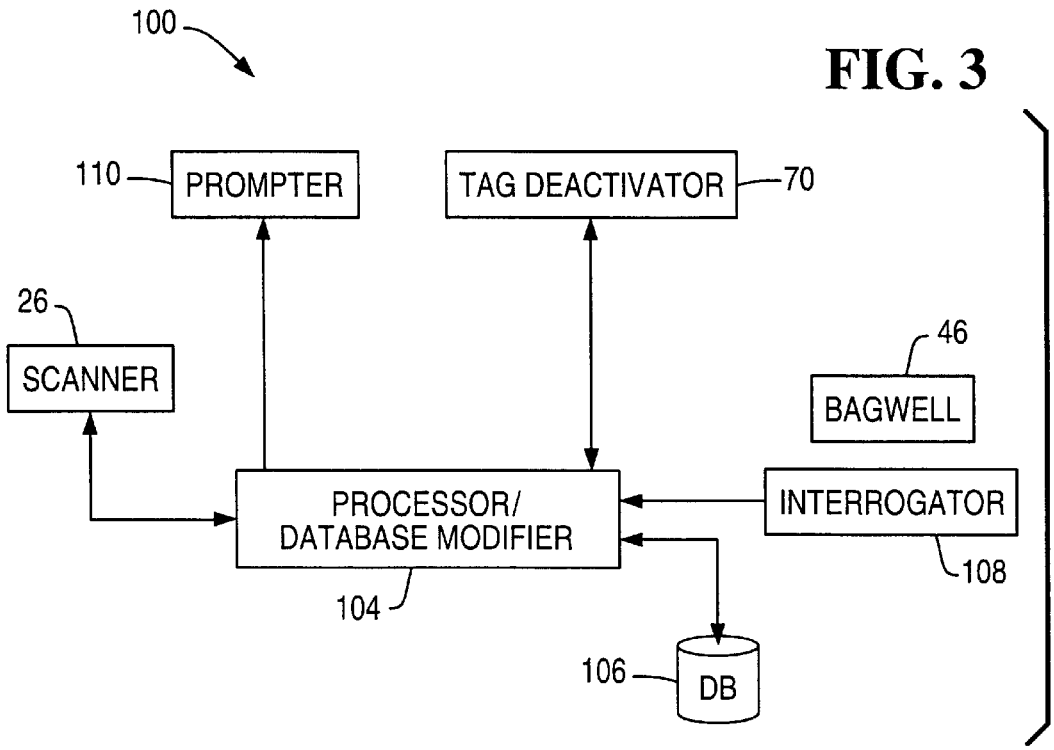
FIG. 3 is a block diagram of a system of the present invention that may be incorporated in the self-checkout station shown in FIG. 1.

A block diagram of an exemplary system incorporating the principles of the present invention is shown in FIG. 3. System 100 includes a processor 104 communicatively coupled to scanner 26, a prompter 110, tag deactivator 70, and interrogator 108. Processor 104 may be the processor of terminal 34 that controls the operation of station 10 or it may be a processor dedicated to the control of system 100. Processor 104 may be any Pentium processor or the like with sufficient volatile memory and hard disk storage for control of system 100. For example, 64 MB of SDRAM and 4 GB of hard drive storage may be deemed adequate for most applications of the present invention. Also appropriate signal interfaces for performing the control actions described below are required as is well known within the art.

Figure 4A:
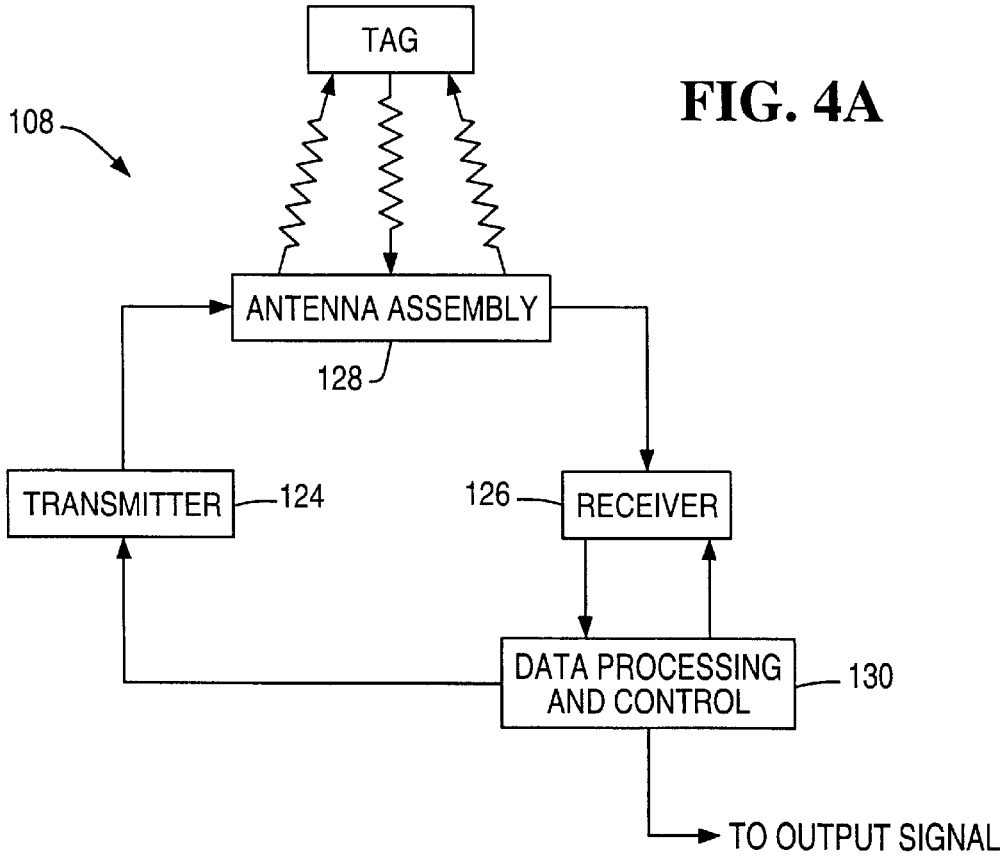
FIG. 4A is block diagram of an interrogator that may be used with the system and method of the present invention.

Interrogator 108 may be any of a variety of known devices that emit a radio frequency, magnetic field, or microwave transmission for the purpose of ascertaining whether an EAS tag is present in the vicinity of interrogator 108. An exemplary interrogator that may be used in the system of the present invention is shown in FIG. 4A. Interrogator 108 includes an antenna assembly 128 to which a transmitter 124 and a receiver 126 are coupled. Receiver 126 and transmitter 124 are coupled to and controlled by data processing and control module 130. Under the control of module 130, transmitter 124 provides an electrical signal to antenna assembly 128 for emission. A tag in the emitted field responds with a radiated signal that is converted by antenna assembly 128 into an electrical signal that is provided to receiver 126. The signal may be further conditioned before being provided to control module 130. Preferably, control module 130 of interrogator 108 provides the received signal to processor 104 as an indication that an EAS tag has responded to the emitted interrogation signal from transmitter 124 and that the ongoing checkout process should be disabled until the EAS tag has been completely deactivated. Processor 104 may use this checkout disable signal from interrogator 108 to prevent further checkout processing.

In response to the checkout disable signal from interrogator 108, processor 104 may disable the operation of scanner 26, ignore further data received from scanner 26, suspend product database queries, or suspend the accumulation of price or subtotal data at checkout station 10. Additionally, processor 104 may inform the consumer of the need to completely deactivate the EAS tag placed in the vicinity of interrogator 108 by providing a prompting signal to prompter 110. Prompter 110 may be an annunciator or a visual display such as the display associated with terminal 34 of checkout station 10. The visual data may include a statement informing the consumer of the need to place the last scanned article with the EAS tag in EAS deactivator 70 for complete deactivation. Alternatively, prompter 110 may emit an audible message, either in voice or tone form, to alert the consumer to the need for deactivating the EAS tag. Preferably, prompter 110 includes audible and visual components to attract the consumer's attention to the active EAS tag. However, the suspension of checkout processing should direct the consumer's efforts to the problem with the last scanned article or lead to consultation with a self-checkout attendant for assistance. Should the consumer withdraw the article with the EAS tag from checkout, scale 48 detects the absence of the last scanned article from bag well 46 and may send a signal to processor 104 indicating the anomaly. In response, processor 104 may display or announce a message to the consumer requesting that the consumer delete the last scanned article from the checkout process so the process may continue. In this manner, a consumer may withdraw an article from the checkout process without requiring attendant assistance.

Figure 4B:
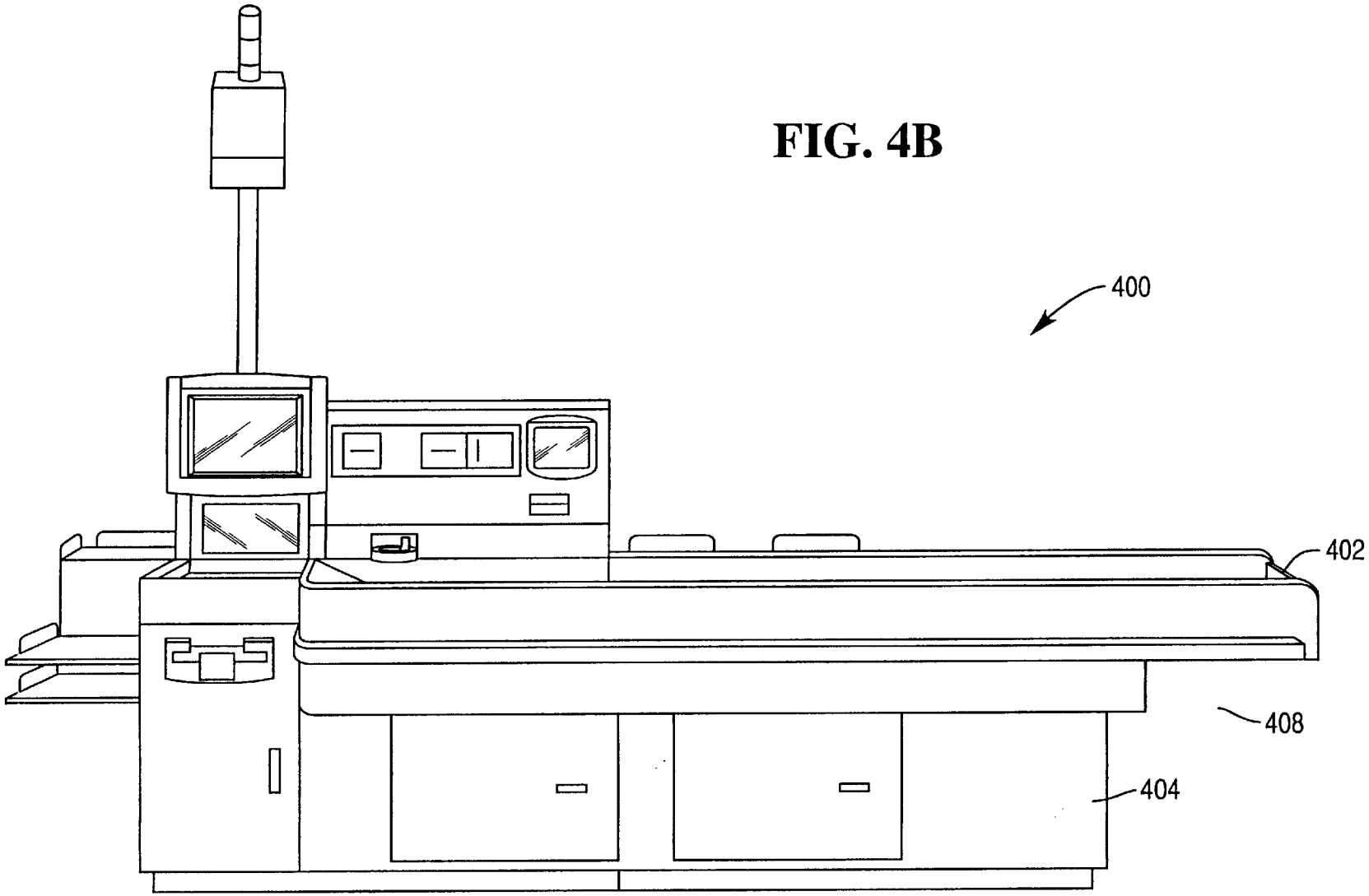
FIG. 4B is a perspective view of a self-checkout station with a take away module in which an interrogator may be located for detecting surveillance tags on scanned articles.

Interrogator 108 may be incorporated within bag well 46 as explained above to detect surveillance tags. In self-checkout stations having a take away belt for scanned items, such as station 400 shown in FIG. 4B, interrogator 108 may be placed proximate outboard end 402 of take away belt module 408 to detect active surveillance tags. For example, an interrogator 108 may be located in housing 404 underneath the traveling belt of take away belt module 408 to detect surveillance tags as articles travel along the belt so consumers may be warned of articles having active tags before bagging the articles.

Figure 5:
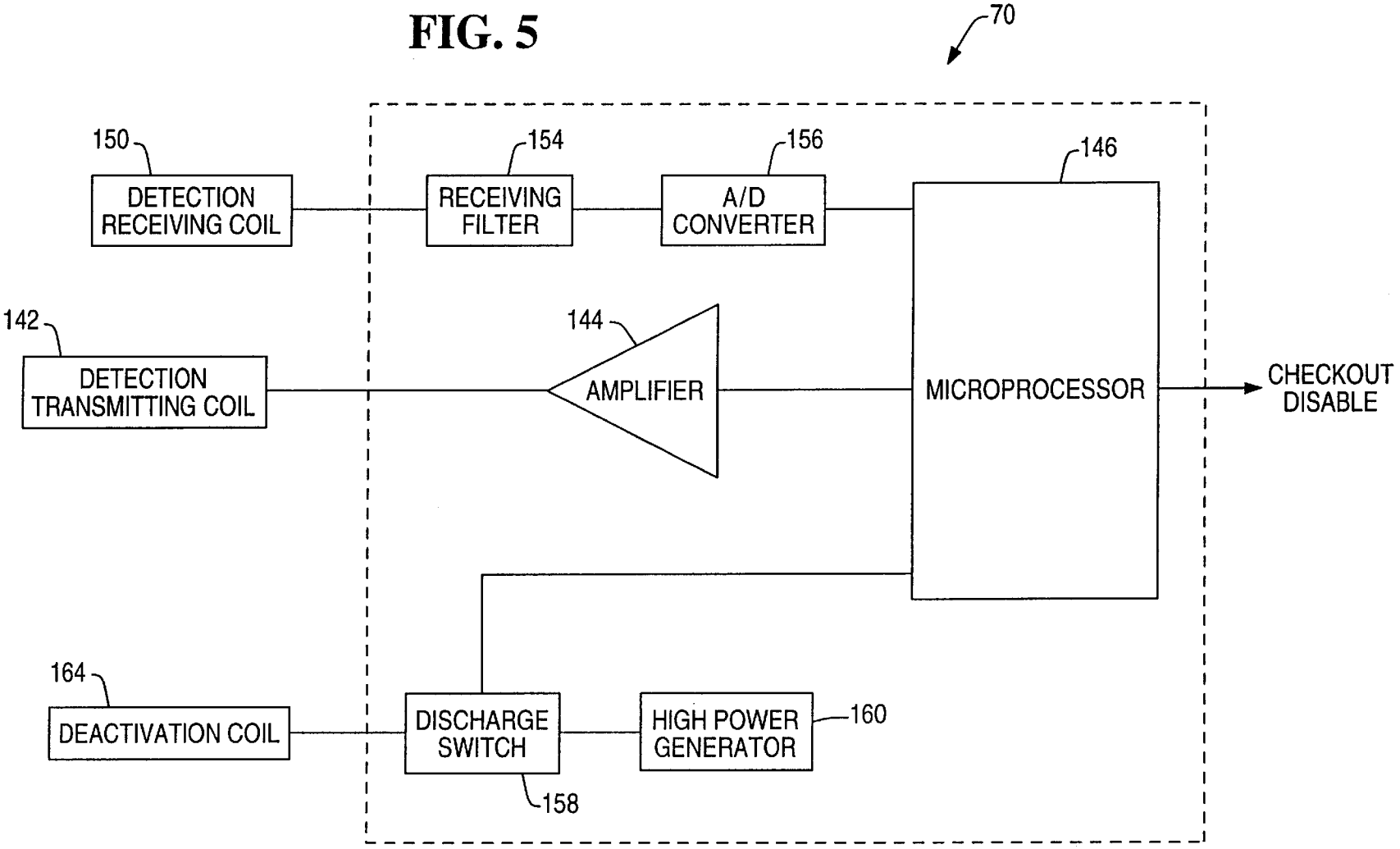
FIG. 5 is a block diagram of an EAS tag deactivator that may be used in the system of FIG. 3.

Preferably, tag deactivator of system 100 includes an interrogator such as interrogator 108 along with the deactivation circuitry and controller. As shown in FIG. 5, EAS deactivator 70 may include an interrogating signal transmission coil 142 that is driven by an amplifier 144 under control of microprocessor 146. The emitted response of an EAS tag is delivered by detection receiving coil 150 to receiving filter 154 for extraction of the EAS tag response signal. The extracted response signal is converted to a digital form for microprocessor 146. In response, microprocessor 146 may generate the checkout disable signal that may be provided to processor 104 for further control of the checkout process. Microprocessor 104 also activates switch 158 to couple power source 160 to deactivation coil 164. When the tag that is generating the EAS response signal is deactivated by the emission from coil 164, the EAS tag no longer responds to the signal from transmitting coil 142 and the extracted response signal is not supplied to microprocessor 146. As a consequence, switch 158 is deactivated and deactivation coil 164 is de-coupled from power source 160. Unfortunately, termination of the signal from deactivation coil 164 also occurs in response to the removal of the article to which the EAS tag is attached from the vicinity of detection coil 150. Hence the proximity of interrogator 108 to bag well 46 permits system 100 to detect EAS tags that have not been deactivated so the checkout disable signal may be generated and the checkout process suspended. Suspension of checkout encourages the consumer to return the article with the EAS tag to deactivator 70 for completion of the deactivation process.

Figure 6A:
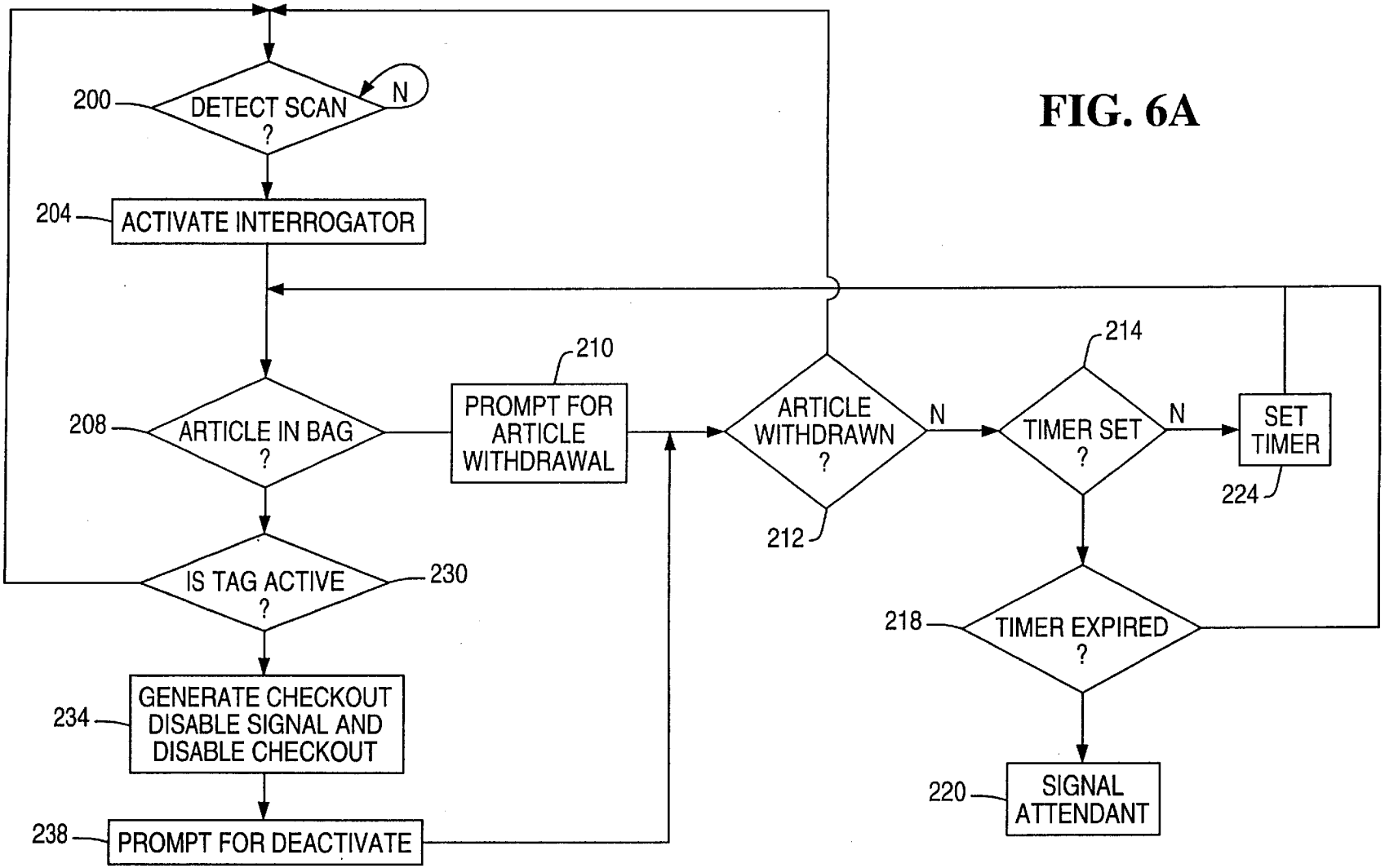
FIG. 6A is a flowchart of an exemplary method that may be used in a system using a single interrogator to implement the principles of the present invention.

An exemplary method that may be used with the system of the present invention is shown in FIG. 6A. The method begins by checking for a scan of an article (block 200). Once a scan is detected, interrogator 108 may be activated and operation variables and parameters initialized (block 204). Alternatively, interrogator 108 may be activated at all times that station 10 is powered or it may be selectively supplied power in response to some other checkout event such as an article scan. The process continues by checking for the detection of the weight of the scanned article in bag well 46 (block 208). This method may be used in an embodiment having a single interrogator 108 that is located in proximity of bag well 46 to detect active EAS tags in the bag well. Known processing occurs with respect to the operation of scale 48 to verify that an article placed in bag well 46 corresponds to the product identification code received at scanner 26. Waiting for detection of an article being placed in bag well 46 gives a consumer time to deactivate an EAS tag, if one is attached to the last article scanned. If no article is detected in the bag well, a prompt is generated to inquire whether the consumer wants to withdraw the last scanned article from the checkout process (block 210). If a positive response to this query is received (block 212) then the process continues by waiting for a new article scan (block 200). If no positive response is received (block 212), the process determines whether a checkout timer has been set (block 214). If it has been set, the process determines whether the timer has expired (block 218) and if it has, a signal is generated to alert the self-checkout station attendant to the need for assistance at the station (block 220). If the timer is set to the delay period value (block 224) or if an active timer has not expired (block 218), the process continues by evaluating whether an article has been placed in the bag well (block 208).

Once an article is detected in bag well 46, the process determines whether interrogator 108 detects an active EAS tag in the bag well (block 230). If one is not detected then the article either did not have an EAS tag attached to it or the EAS tag has been completely deactivated. The processing associated with security scale 48 helps ensure that a second article has not been substituted for the last scanned article and the process continues by waiting for the next article scan (block 200). If an active EAS tag is detected in the bag well, the checkout disable signal is generated (block 234) so one or more checkout components may be disabled to suspend the checkout process. A prompt may be displayed to the consumer advising the consumer to either deactivate the EAS tag or to withdraw the article from the checkout process (block 238). The process determines whether the consumer withdraws the article from checkout (block 212). If the article is withdrawn, the process waits for the next article scan or a signal from the consumer to complete checkout. Otherwise, the process waits for the checkout delay period so the consumer may either deactivate the EAS tag or withdraw the article.

Figure 6B:
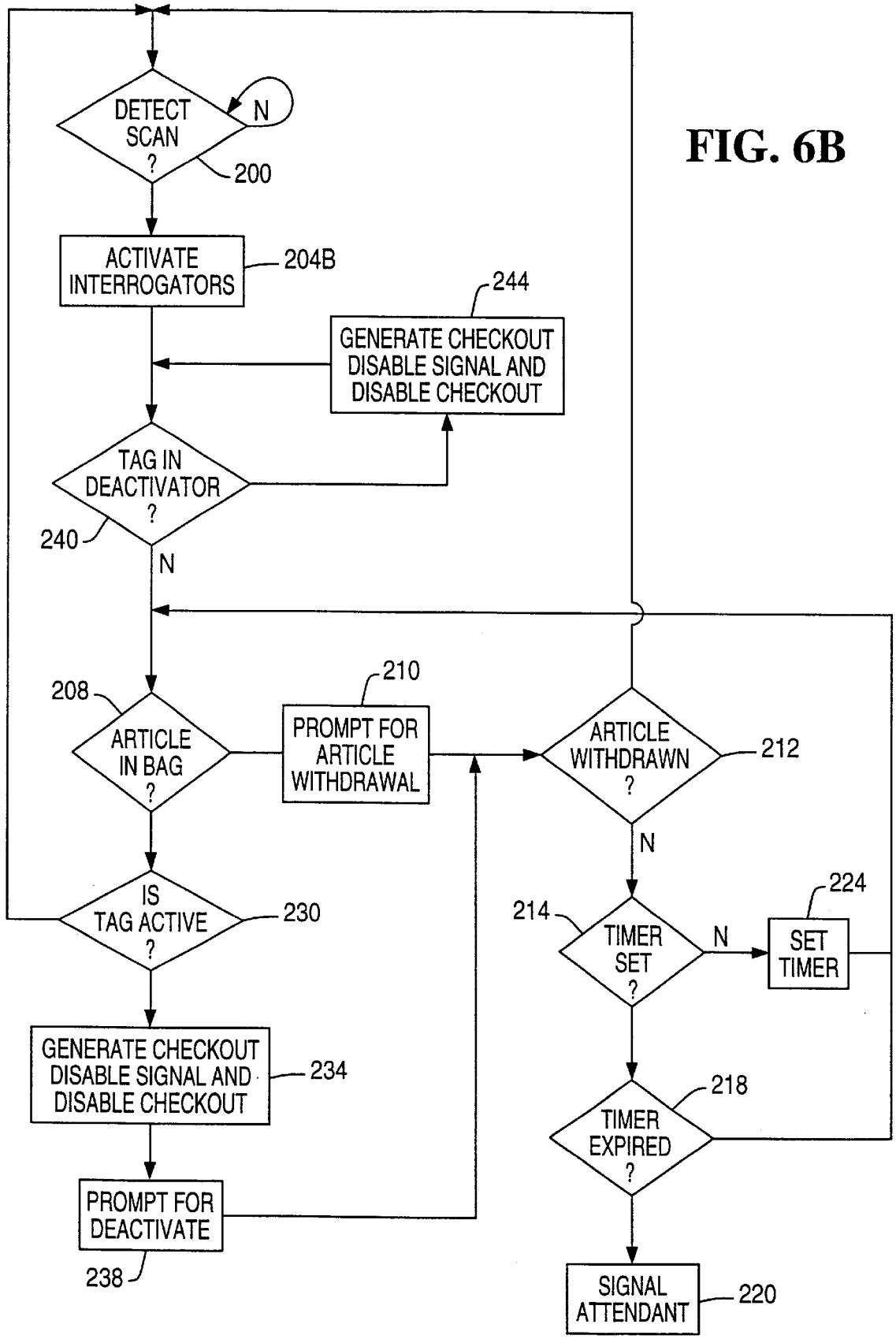
FIG. 6B is a flowchart of an exemplary method that may be used in a system using two interrogators to implement the principles of the present invention.

An embodiment having two interrogators, one preferably associated with EAS deactivator 70 and the other associated with bag well 46, may use the exemplary method depicted in FIG. 6B. That method is similar to the method of FIG. 6A except both interrogators may be activated (block 204B). Alternatively, other checkout events may be used to activate the interrogators or they may remain activated as long as station 10 is powered. The process includes an evaluation as to whether the first interrogator detects an active EAS tag in the EAS deactivator (block 240). If one is detected, a checkout disable signal is generated (block 244). The checkout disable signal remains active until the first interrogator no longer detects an EAS tag in EAS deactivator 70. If the consumer attempts to remove the article from the checkout process without notification, the security scale processing (block 208) determines whether the article has been placed in the bag well as discussed above. Once the article corresponding to the last scanned product data is detected in the bag well, the second interrogator determines whether the EAS tag has been fully deactivated (block 230) as discussed above. Thus, the method of FIG. 6B generates a checkout disable signal as long as either an active EAS tag is detected in deactivator 70 or bag well 46.

In operation, a self-checkout station is modified to include an EAS deactivator and at least one interrogator for detecting active EAS tags in the bag well. Preferably, the EAS deactivator is located between the scanner and the bag well of the checkout station to facilitate access to the deactivator and encourage its use by the consumer. The program for interfacing a processor to the interrogator, deactivator, and other station components is then loaded into memory or otherwise made available for execution by the processor as is well known. Thereafter, the interrogator detects active EAS tags in the bag well of the station and, in response, generates a checkout disable signal. The processor uses the checkout disable signal to suspend the checkout process. Such suspension may be accomplished by disabling the operation of the scanner, ignoring scan data from the scanner, disabling checkout computations, or the like. Prompts, either audible, visual, or a combination thereof, may be provided to assist the consumer in understanding the need for either deactivating the EAS tag or withdrawing the article from the checkout process. If the consumer does not deactivate the EAS tag or withdraw the article from the checkout process within a reasonable checkout delay period, a signal may be generated to obtain self-checkout station attendant assistance for the consumer.

Preferably, two interrogators are provided with one interrogator being associated with the bag well and the other being associated with the EAS deactivator. Both interrogators generate checkout disable signals in response to the presence of an active EAS tag in the bag well and EAS deactivator, respectively.

While the present invention has been illustrated by the description of exemplary processes and system components, and while the various processes and components have been described in considerable detail, applicant does not intend to restrict or in any limit the scope of the appended claims to such detail. Additional advantages and modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A system for verifying successful deactivation of an EAS tag at a self-checkout station comprising:

an EAS tag deactivator associated with a self-checkout station for deactivating an EAS tag attached to an article scanned at the s elf-checkout station;

an EAS tag interrogator associated with a bag well of the checkout station, the EAS tag interrogator generating an electrical checkout disable signal in response to detection of the EAS tag in the bag well by the EAS tag interrogator so that the checkout process is suspended until the EAS tag has been completely deactivated or withdrawn from the checkout process; and a processor for receiving the generated checkout disable signal and disabling a scanner so that additional articles may not be submitted for checkout to disable the checkout process until the EAS tag is completely deactivated or the article to which the EAS tag is attached is withdrawn from the checkout process.

2. The system of claim 1 further comprising:

a prompter for prompting deactivation of the EAS tag attached to the article within the bag well.

3. The system of claim 2 wherein the prompter is a display for providing a visual prompt.

4. The system of claim 1 wherein the prompter is an annunciator for providing an audible prompt.

5. A system for verifying successful deactivation of an EAS tag at a self-checkout station comprising:

an EAS tag deactivator associated with a self-checkout station for deactivating an EAS tag attached to an article scanned at the self-checkout station;

an EAS tag interrogator associated with a bag well of the checkout station, the EAS tag interrogator generating an electrical checkout disable signal in response to detection of the EAS tag in the bag well by the EAS tag interrogator so that the checkout process is suspended until the EAS tag has been completely deactivated or withdrawn from the checkout process; and a processor for receiving the generated checkout disable signal and disabling queries of a product database to disable the checkout process until the EAS tag is completely deactivated or the article to which the EAS tag is attached is withdrawn from the checkout process.

6. The system of claim 5 further comprising:

a prompter for prompting deactivation of the EAS tag attached to the article within the bag well.

7. The system of claim 6 wherein the prompter is a display for providing a visual prompt.

8. The system of claim 6 wherein the prompter is an annunciator for providing an audible prompt.

9. A system for verifying successful deactivation of an EAS tag at a self-checkout station comprising:

an EAS tag deactivator associated with a self-checkout station for deactivating an EAS tag attached to an article scanned at the self-checkout station;

an EAS tag interrogator associated with a bag well of the checkout station, the EAS tag interrogator generating an electrical checkout disable signal in response to detection of the EAS tag in the bag well by the EAS tag interrogator so that the checkout process is suspended until the EAS tag has been completely deactivated or withdrawn from the checkout process; and a processor for receiving the generated checkout disable signal and disabling accumulation of subtotal data for the checkout to disable the checkout process until the EAS tag is completely deactivated or the article to which the EAS tag is attached is withdrawn from the checkout process.

10. The system of claim 9 further comprising:

a prompter for prompting deactivation of the EAS tag attached to the article within the bag well.

11. The system of claim 10 wherein the prompter is a display for providing a visual prompt.

12. The system of claim 10 wherein the prompter is an annunciator for providing an audible prompt.

13. A method for verifying successful deactivation of an EAS tag at a self-checkout station comprising:

interrogating an EAS tag attached to an article located proximate a bag well at a self-checkout station;

generating an electrical checkout disable signal in response to detection of the EAS tag by the EAS tag interrogation so that a consumer cannot continue the checkout process until the EAS tag has been completely deactivated or the article to which the EAS tag is attached is withdrawn from the checkout process;

receiving the generated checkout disable signal; and disabling a scanner of the self-checkout station so that a consumer may not submit additional articles for checkout to disable the checkout process until the EAS tag is completely deactivated or the article to which the EAS tag is attached is withdrawn from the checkout process.

14. The method of claim 13 further comprising:

prompting a consumer to deactivate the EAS tag attached to the scanned article.

15. The method of claim 14 wherein the prompting includes displaying a visual prompt.

16. The method of claim 14 wherein the prompting includes annunciating an audible prompt.

17. A method for verifying successful deactivation of an EAS tag at a self-checkout station comprising:

interrogating an EAS tag attached to an article located proximate a bag well at a self-checkout station;

generating an electrical checkout disable signal in response to detection of the EAS tag by the EAS tag interrogation so that a consumer cannot continue the checkout process until the EAS tag has been completely deactivated or the article to which the EAS tag is attached is withdrawn from the checkout process;

receiving the generated checkout disable signal; and disabling queries of a product database to disable the checkout process until the EAS tag is completely deactivated or the article to which the EAS tag is attached is withdrawn from the checkout process.

18. The method of claim 17 further comprising:

prompting a consumer to deactivate the EAS tag attached to the scanned article.

19. The method of claim 18 wherein the prompting includes displaying a visual prompt.

20. The method of claim 18 wherein the prompting includes annunciating an audible prompt.

21. A method for verifying successful deactivation of an EAS tag at a self-checkout station comprising:

interrogating an EAS tag attached to an article located proximate a bag well at a self-checkout station;

generating an electrical checkout disable signal in response to detection of the EAS tag by the EAS tag interrogation so that a consumer cannot continue the checkout process until the EAS tag has been completely deactivated or the article to which the EAS tag is attached is withdrawn from the checkout process;

receiving the generated checkout disable signal; and disabling accumulation of subtotal data for the checkout to disable the checkout process until the EAS tag is completely deactivated or the article to which the EAS tag is attached is withdrawn from the checkout process.

22. The method of claim 21 further comprising:

prompting a consumer to deactivate the EAS tag attached to the scanned article.

23. The method of claim 22 wherein the prompting includes displaying a visual prompt.

24. The method of claim 22 wherein the prompting includes annunciating an audible prompt.

* * * * *